United States Patent [19]

Jonsson

[11] Patent Number: 4,760,817

[45] Date of Patent: Aug. 2, 1988

[54] FLUIDIZED BED COMBUSTION CHAMBER IN A POWER PLANT

[75] Inventor: Arne Jonsson, Finspong, Sweden

[73] Assignee: Asea Stal Aktiebolag, Finspong, Sweden

[21] Appl. No.: 127,301

[22] Filed: Dec. 2, 1987

[30] Foreign Application Priority Data

Dec. 3, 1986 [SE] Sweden ..... 8605200

[51] Int. Cl.[4] ..... F22B 37/24

[52] U.S. Cl. ..... 122/510; 122/4 D; 165/162

[58] Field of Search ..... 122/4 D, 510, 493, 511; 165/162

[56] References Cited

U.S. PATENT DOCUMENTS 4,304,574 12/1981 Buchner et al. ..... 122/510
4,510,892 4/1985 Wincze et al. ..... 122/510
4,576,120 3/1986 Ammann ..... 122/510 X
4,655,147 4/1987 Brannstrom et al. ..... 122/4 D X

FOREIGN PATENT DOCUMENTS 0041648 12/1981 European Pat. Off. .
1146499 4/1963 Fed. Rep. of Germany .

*Primary Examiner*—Edward G. Favors
*Attorney, Agent, or Firm*—Pollock, Vande Sande & Priddy

[57] ABSTRACT

The corners of the walls of a vessel in which fuel is burnt in the fluidized bed of a PFBC power plant are articulately connected to a supporting framework. The forces arising on the bed vessel walls are taken up by the framework and are transmitted to the framework by means of a plurality of links. At each corner the construction of links allows the corner to be displaced in relation to the framework. This corner-connection includes auxiliary beams which are substantially parallel to the walls and are at one of their ends articulately connected to the framework.

10 Claims, 4 Drawing Sheets

FLUIDIZED BED COMBUSTION CHAMBER IN A POWER PLANT

TECHNICAL FIELD

This invention relates to the construction of the bed vessel in a fluidized bed power plant. In such a plant fuel is burnt in a fluidized bed of particulate material contained in a bed vessel. The bed vessel is usually a sulfur absorbing particulate material and the combustion typically occurs at a pressure close to atmospheric pressure or at a considerably elevated pressure. In the latter case, the pressure may amount to 2 MPa or more. Combustion gases generated in the bed vessel are normally utilized in one or more turbines for driving a compressor (which is used to supply the bed vessel with combustion air) and a generator (which, for example, delivers current to an electricity supply system).

A power plant which operates with the combustion occurring at elevated pressure is usually designated a "PFBC" (Pressurized Fluidized Bed Combustion) power plant. In a PFBC plant, the bed vessel and usually also a cleaning plant for the combustion gases leaving the bed vessel, are enclosed within a pressure vessel.

BACKGROUND ART AND THE TECHNICAL PROBLEM

In a PFBC plant, the walls of the bed vessel are subjected to very large forces because of the pressure difference appearing across the walls of the bed vessel. In a PFBC power plant with the bed vessel enclosed within a pressure vessel and surrounded by compressed combustion air, a pressure difference arises in operation of the plant between the space in the pressure vessel around the bed vessel and the space inside the bed vessel, because of a pressure drop arising in the fluidized bed. This pressure difference may amount to the order of magnitude of 0.1 MPa (1.0 bar). The walls of the bed vessel may have an area of 200 $m^2$, and therefore the forces acting on the bed vessel walls are very large, which, having regard to the high temperatures involved, present design problems which are difficult to solve.

The bed vessel is normally of rectangular cross-section and its walls are usually water-cooled. A common construction for the walls consists of panels of vertical coolant tubes which are joined together by intermediate flanges. The tubes can contain feed water to be preheated prior to circulating in the main heat-exchange tubes of the plant. The walls of the bed vessel are not, by themselves capable of withstanding the loads arising because of the pressure difference across the walls. The bed vessel is therefore surrounded by a rigid force-absorbing framework. The bed vessel is supported within this framework by means of force transmitting bars or links. In the case of a cold plant, the framework and the bed vessel walls will have the same temperature but during operation of the plant the walls of the bed vessel assume a temperature close to that of the circulating coolant and the framework assumes a different temperature close to that of the surrounding air. Because of the temperature differences arising between the walls of the bed vessel and the force-absorbing framework, the bed vessel may expand or contract relative to the framework.

The connection between the framework and the bed vessel must be made in such a way that the difference in expansion does not give rise to dangerous stresses in the bed vessel, in the framework, or in the connecting links between the bed vessel and the framework.

German Offenlegungsschrift No. 2 055 803 shows one way of constructing the connection between a conventional boiler and a force-absorbing framework.

SUMMARY OF THE INVENTION

According to the invention, at least two bars or links at each corner of the bed vessel are connected to an auxiliary beam, which is substantially parallel to the beams of the framework and is articulately attached to the framework at its end which is furthest away from the corner. When the auxiliary beam and the bed vessel are connected to each other by bars, these must be elastically deformable. The auxiliary beam is suitably connected to the bed vessel wall by means of a plurality of links which are articulately joined to both the auxiliary beam and the bed vessel wall. Suitably the auxiliary beam is articulately joined to a bracket on the bed vessel walls meeting at the corner of the bed vessel.

BRIEF DESCRIPTION OF THE DRAWINGS

The invention will now be further described, by way of example, with reference to the accompanying drawings, in which.

DESCRIPTION OF THE PREFERRED EMBODIMENTS

Figure 1:
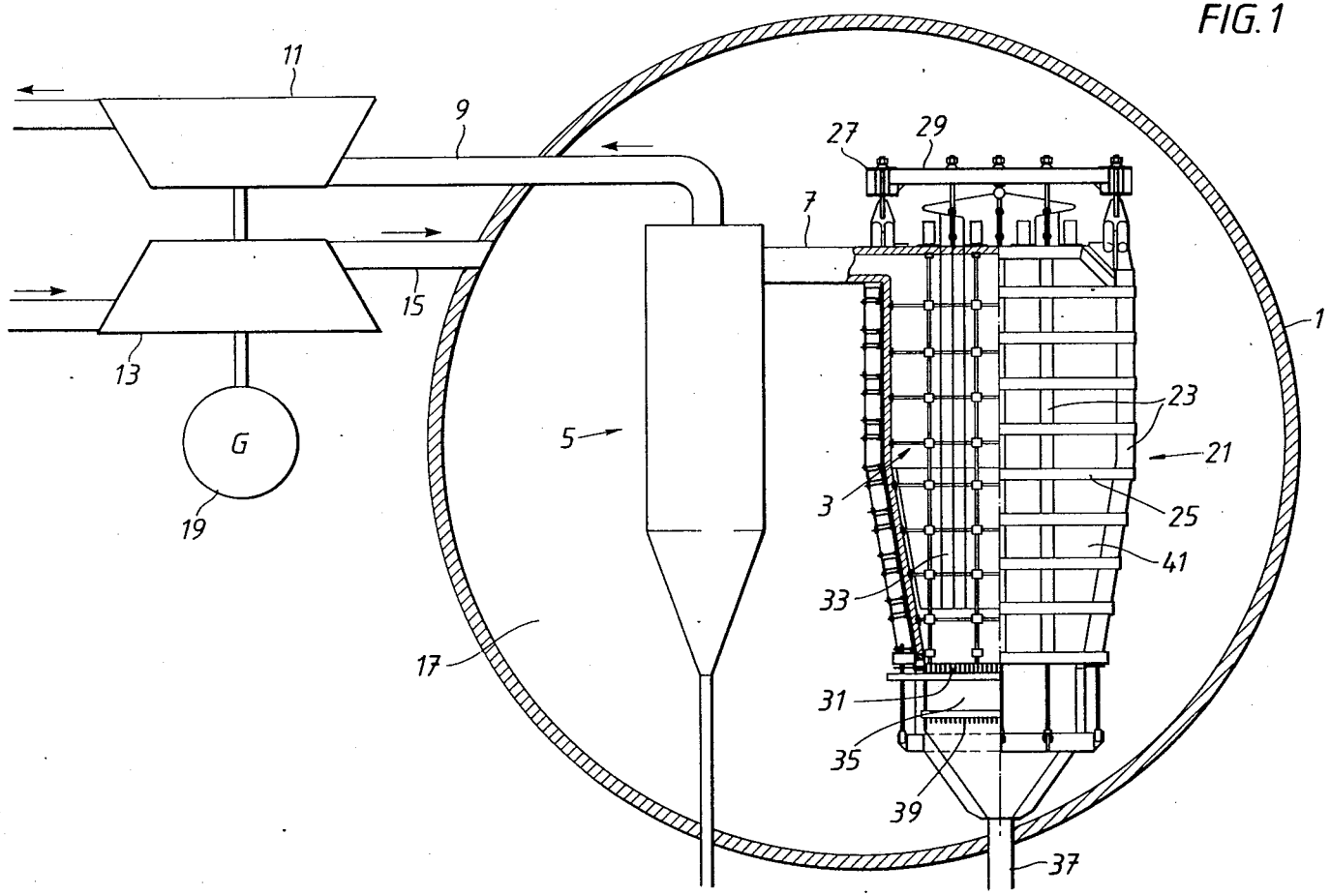
FIG. 1 schematically shows a PFBC power plant with a bed vessel which is surrounded by a force-absorbing framework, FIG. 2 schematically shows, on a much enlarged scale, one corner of the framework and of the bed vessel under conditions of equal temperature in the framework and in the bed vessel wall.

FIG. 1 of the drawings shows a PFBC power plant in which 1 designates a pressure vessel, 3 a bed vessel and 5 a gas cleaning plant of cyclone type enclosed within the pressure vessel 1. Only one cyclone is shown, but in reality the cleaning plant 5 comprises a plurality of parallel groups of series-connected cyclones. Combustion gases generated in the bed vessel 3 are passed through the conduit 7 to the cleaning plant 5 and from there through a conduit 9 to a turbine 11. The turbine 11 drives a compressor 13 which, via a conduit 15, supplies the space 17 within the pressure vessel 1 with compressed combustion air with a pressure which may amount to 2 MPa or more. The turbine 11 also drives a generator 19, which feeds out energy to an electricity supply system (not shown). The generator 19 may also be utilized as a starter motor for the power plant. The turbine-compressor part 11, 13 may be built up in many different ways in accordance with known techniques. The plant also includes a fuel feed system and an ash discharge system, but for convenience, these have not been shown. However, systems of the type shown in Brännström U.S. patent application Nos. 861,212 (filed May 9, 1986) and 563,427 (filed Dec. 20, 1983) or other conventional fuel supply or ash discharge equipment could be used.

The bed vessel 3 is surrounded by a framework 21 built up of vertical and horizontal beams 23 and 25, respectively. The bed vessel 3 and the framework 21 are both suspended from a beam system comprising longitudinal and transverse beams 27 and 29, respectively. The beams 27 are attached to the wall of the pressure vessel 1 or are supported by columns (not shown). The framework 21 and the bed vessel 3 are separately suspended from the beams 27 and 29 so as to enable relative movement therebetween. The bed vessel 3 has a bottom plate 31 provided with air nozzles through which the space 33 within the bed vessel is supplied with air for fluidization of a particulate bed material and for combustion of fuel forming part of the bed material. The bottom plate 31 is also provided with openings allowing consumed bed material to fall down into a space 35 and to be discharged therefrom through a discharge conduit 37. The space 35 accommodates a tubular coil 39 provided with openings through which cooling air may be supplied to the space 35 to cool the bed material that is being discharged.

The bed vessel 3 comprises a gas-tight sheet metal wall 41 with side walls 41*a* and end walls 41*b*. Owing to the flow resistance created in the nozzles of the bottom plate 31 and by the fluidized bed material, a pressure difference arises between the space 17 around the bed vessel 3 and the bed vessel space 33. This pressure difference may amount to 0.1 MPa. The walls 41*a* and 41*b*, which may have a length of 20 m and 10 m, respectively, and a height of 10 m or more, will thus be subjected to very large forces.

For absorbing these, normally inwardly-directed, forces the walls 41*a* and 41*b* of the bed vessel 3 are each connected to the horizontal beams 25 of the framework 21 by means of a plurality of horizontal links 43 preventing the walls 41*a* and 41*b* from curving inwards and buckling at compressive load in the plane of the walls 41*a*, 41*b*. The walls 41*a*, 41*b* of the bed vessel 3 each consist of spaced-apart vertical tubes 55 which are interconnected by flanges 57. On their outer sides, the walls 41*a* and 41*b* are each provided with a heat-insulating layer 59. The walls 41*a* and 41*b* are cooled by coolant flowing through the tubes 55 (for example, by feed water for steam generating tubes (not shown) arranged in the bed vessel 3).

Figure 2:
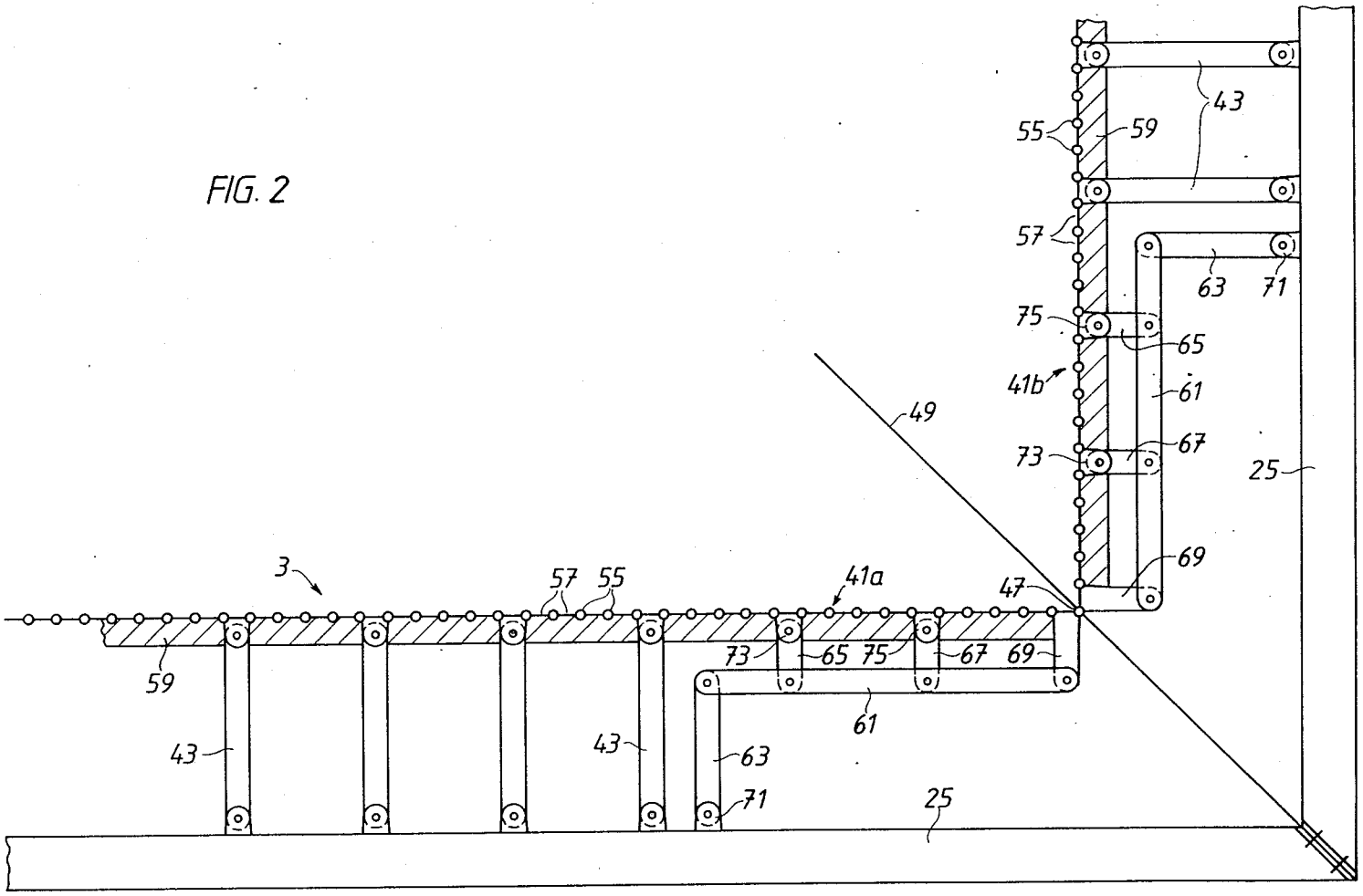
Figure 3:
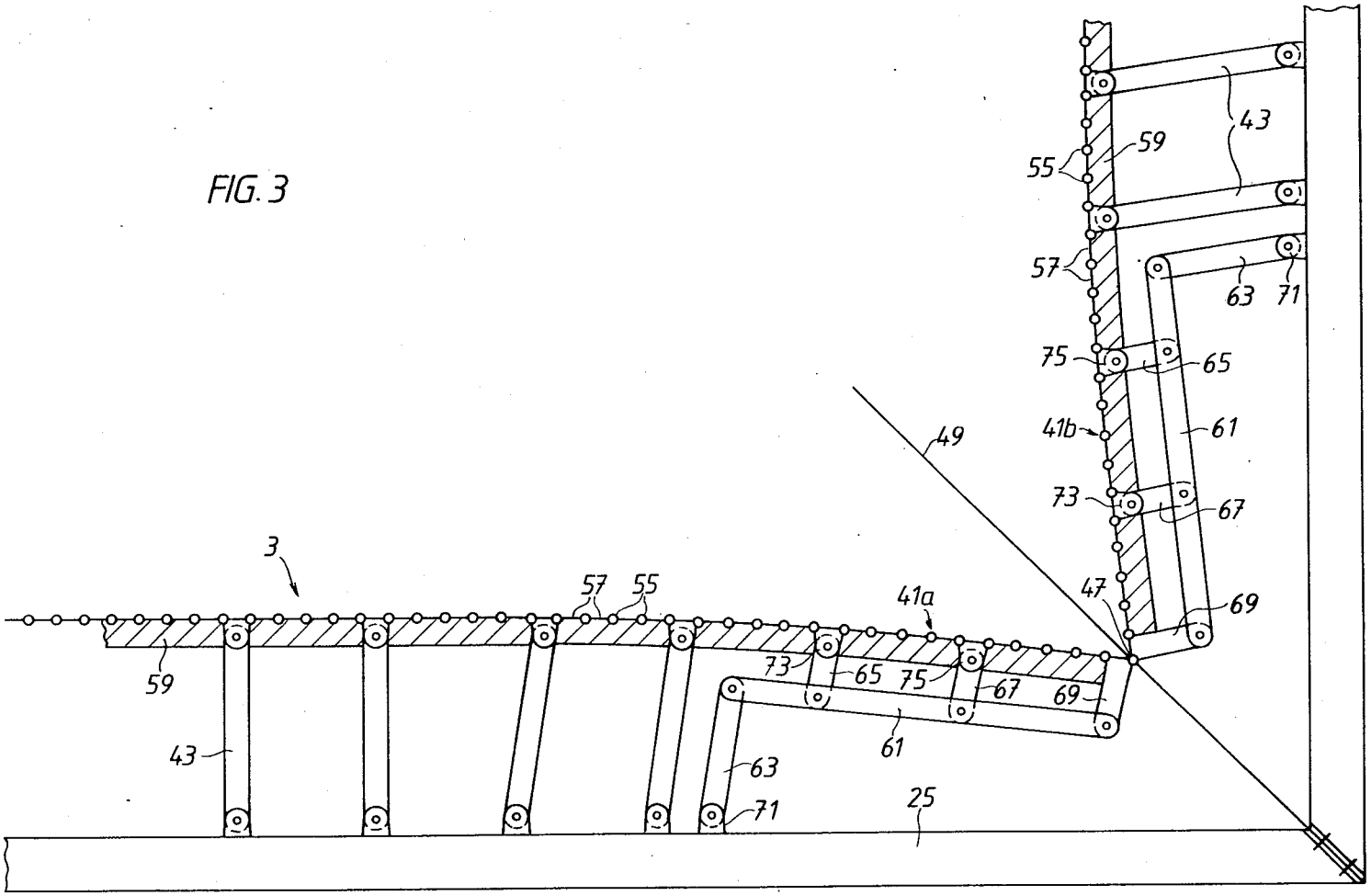
FIG. 3 shows the same corner as FIG. 2 but illustrates the situation where the bed vessel wall has attained a higher temperature than that of the framework.
Figure 4:
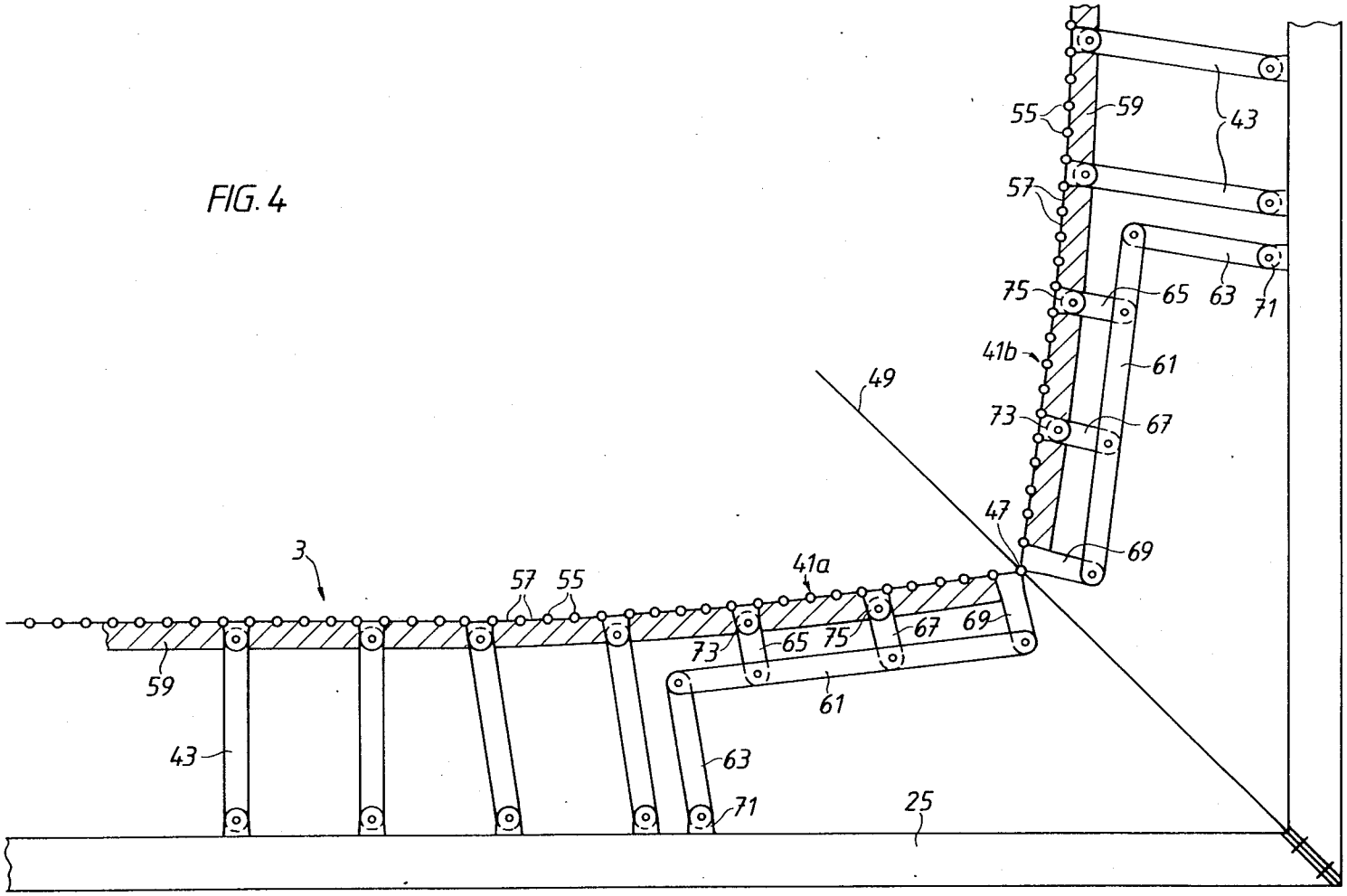
FIG. 4 shows the same corner as FIG. 2 but illustrates the situation where the framework has attained a higher temperature than that of the bed vessel wall.

As shown in FIGS. 2–4, in the vicinity of a corner 47, each wall 41*a* and 41*b* of the bed vessel 3 is indirectly connected to the beams 25 of the framework 21 by means of an auxiliary beam 61, links 63, 65 and 67 and a bracket 69. Each link 63 is articulately journalled at one end in a bracket 71 on the respective framework beam 25 and at the other end is articulately connected to the auxiliary beam 61. Each link 65 and 67 is articulately connected to a respective bracket 73 and 75 on the wall 41*a* or 41*b*. Each auxiliary beam 61 is articulately connected to the corner bracket 69 which is fixedly connected to the bed vessel walls 41*a* and 41*b*, respectively.

FIG. 2 shows the situation existing in the case of a cold plant. When putting the plant into operation, both the bed vessel 3 and the framework 21 are heated. The bed vessel walls 41*a*, 41*b* assume approximately the same temperature as the coolant in the tubes 55, and the framework 21 assumes substantially the same temperature as the compressed air in the space 17 in the pressure vessel 1. If the bed vessel walls 41*a*, 41*b* attain a higher temperature than that of the framework 21, the bed vessel 3 will expand to a greater extent than the framework 21 and its corner 47 will be displaced outwardly along the diagonal 49 of the bed vessel 3 to a new position (e.g. as shown in FIG. 3), the corner bracket 69 opening somewhat to allow for this. Because of the flexible connection of each wall 41*a*, 41*b* to the framework 21 at the corner 47, the thermal deformation arising in the relatively slender walls 41*a*, 41*b* does not give rise to any problems from the point of view of strength.

If the framework 21 should assume a higher temperature than that of the bed vessel walls 41*a*, 41*b*, the corner 47 is displaced inwards and the repositioned arrangement of the corner supports of the walls would be somewhat as shown in FIG. 4, the corner bracket 69 now closing somewhat.

In place of a single corner bracket 69 fixedly connected to both walls 41*a*, 41*b* which meet at the corner 47, a separate corner bracket can be attached to each wall.

Various modifications can clearly be made to the constructions shown in the drawings and all such modifications falling within the scope of the following claims should be taken to represent constructions within the ambit of this invention.

what is claimed is:

1. A PFBC power plant including:

a pressure plant;

a bed vessel enclosed within the pressure vessel, means in the bed vessel to create a fluidized bed of particulate material therein and to burn fuel in the said bed, the bed vessel being defined by walls which meet at corners of the bed vessel;

a framework of beams supported within the pressure vessel and surrounding the bed vessel, and a plurality of links extending substantially perpendicularly to the walls of the bed vessel, said links being connected both to the bed vessel walls and to the framework, said links being adapted to transmit forces, acting on the bed vessel walls to the framework;

characterized in that at the corners of the bed vessel auxiliary beams are provided which are substantially parallel to beams of the framework and are articulately connected to the framework at their ends located furthest away from the corners, and in that each of the two walls of the bed vessel which meet at a corner are connected to a respective one of said auxiliary beams by at least two bars.

2. A power plant according to claim 1, in which the bars between each bed vessel wall and the respective auxiliary beam are articulately connected to the respective auxiliary beam.

3. A power plant according to claim 1, in which each bed vessel wall is articulately connected to the plurality of links which are articulately connected to the beams of the framework.

4. A power plant according to claim 2, in which each bed vessel wall is articulately connected to the plurality of links which are articulately connected to the beams of the framework.

5. A power plant according to claim 1, in which the end of each auxiliary beam which is most remote from the corner is connected to the framework by means of a link bar which is articulately connected at one end to the framework and at the other end to the auxiliary beam.

6. A power plant according to claim 2, in which the end of each auxiliary beam which is most remote from the corner is connected to the framework by means of a link bar which is articulately connected at one end to the framework and at the other end to the auxiliary beam.

7. A power plant according to claim 3, in which the end of each auxiliary beam which is most remote from the corner is connected to the framework by means of a link bar which is articulately connected at one end to the framework and at the other end to the auxiliary beam.

8. A power plant according to claim 4, in which the end of each auxiliary beam which is most remote from the corner is connected to the framework by means of a link bar which is articulately connected at one end to the framework and at the other end to the auxiliary beam.

9. A power plant according to claim 5, in which the end of each auxiliary beam which is closest to the corner is articulately connected to a bracket which is fixedly connected to the respective wall of the bed vessel at the corner.

10. A power plant according to claim 9, in which the bracket is common to both walls which meet at the corner.

* * * * *